United States Patent [19]

Kraizinger et al.

[11] 3,972,517

[45] Aug. 3, 1976

[54] TUYERE FOR INTRODUCING REACTANTS INTO A BATH OF MOLTEN METAL

[76] Inventors: Fedor Vladimirovich Kraizinger, prospekt Metallurgov, 219, kv. 70; Vitaly Vasilievich Pogoretsky, ulitsa Pushkina, 66; Dmitry Apelovich Tarpinian, prospekt Stroitelei, 110, kv. 57; Valery Petrovich Popov, ulitsa Stepnaya, 2, kv. 71, all of Zhdanov, Donetskoi oblasti; Alexandr Alexeevich Perimov, B. Filevskaya ulitsa, 41, korpus 3, kv. 30; Vladimir Pavlovich Glinkin, ulitsa Verkhnaya Maslovka, 8, kv. 43, both of Moscow, all of U.S.S.R.

[22] Filed: Aug. 5, 1974

[21] Appl. No.: 494,924

[52] U.S. Cl. ..... 266/225; 239/132.3

[51] Int. Cl.[2] ..... C21C 7/00

[58] Field of Search ..... 239/132.3, 132.5, 299, 239/601; 266/34 L, 34 LM

[56] References Cited

UNITED STATES PATENTS

| | | | |
|---|---|---|---|
| 2,433,610 | 12/1947 | Hughey | 239/132.3 |
| 3,680,785 | 8/1972 | Miller | 239/132.3 |

*Primary Examiner*—Gerald A. Dost

*Attorney, Agent, or Firm*—Holman & Stern

[57] ABSTRACT

The tuyere incorporates an elongated water-cooled tubular casing for admitting a flow of a gaseous reactant. Disposed co-axially in the casing is a pipe for admitting a flow of another reactant installed with provision for axial displacement. At the outlet from the casing there is provided a stopper with nozzles, said stopper being held fast on the pipe by means of its central portion. The internal surface of the casing mates the external side surface of the stopper with a region where said stopper is fitted, assuring the setting of the stopper into the working position with an interference bit. The withdrawal of the stopper from the working position is accomplished with the aid of said movable pipe.

4 Claims, 2 Drawing Figures

TUYERE FOR INTRODUCING REACTANTS INTO A BATH OF MOLTEN METAL

BACKGROUND OF THE INVENTION

The present invention relates to converter steel production by top blowing of oxidizing reactants delivered to the initial materials and more specifically to tuyeres for introducing reactants into a bath of molten metal. Commonly used as oxidizing reactants in this case is gaseous oxygen introduced alone or in a mixture with powder materials.

The term "bath of molten metal" as used hereinafter denotes a mass of molten metal which can be liquid cast iron, and the "particulate materials" mean scrap and slag-forming additives, such as lime, slag forming materials and the like additives.

Widely known in the art is a tuyere for introducing oxygen into a bath of molten metal consisting of an elongated water-cooled casing through a bore of which a flow of oxygen with powder materials is being fed. At the outlet, the casing internal surface is given the shape of a cone diverging towards the outside and forming thus a cooling shield. Installed at the outlet from the casing before the cone-shaped portion there is a replaceable stopper provided with nozzles and made of a heat-proof material.

The water-cooled tapered portion of the tuyere casing gives the stopper protection against splashing slag and metal. On a side surface of the stopper facing the casing there is an annular collar resting on a split ring which consists, for example, of four parts disposed on a corresponding annular collar provided on the internal surface of casing.

To replace the stopper, it is displaced into the casing bore so as to become separated from the parts of split ring, said parts are withdrawn and then is withdrawn the stopper from the casing. To insert a new stopper, the procedure is repeated in the reverse order.

To simplify the job of replacing said stopper, it must easily fit the split ring. This fact and also the presence of unavoidable clearances at contact between the stopper, parts of ring and casing are likely to bring about leaks of oxygen through said clearances with the result that the rate of blast will be changed. Furthermore, the introduction of particulate materials in conjunction with oxygen through narrow nozzles of the stopper is a problem by itself.

Further known is a tuyere in which particulate materials are introduced through a separate co-axial pipe immovably installed in the casing bore. Said tuyere has a replaceable stopper with nozzles threadedly attached to the casing at the outlet. In this case, the replacement of a damaged stopper is a problem due to the danger of damaging the thread exposed to high temperatures in the reaction zone. Also nozzles of the stopper are likely to be blinded to splashing slag and metal.

Finally known is a tuyere for blowing oxygen through cast iron which consists of an elongated water-cooled tubular casing disposed wherein is also a co-axial pipe. Oxygen is introduced through said tuyere in two flows at different pressures. While fed through the casing is oxygen at low rate of flow and pressure, blown through the pipe is oxygen at high rate of flow and pressure with or without finely-ground materials in the form of suspension. The oxygen introduced through the casing at low rate of flow and pressure brings about frothing of slag and improves dephosphorization. Also the blowing with oxygen under low pressure allows to increase the amount of scrap in the charge. On the other hand, the excessive frothing of slag occuring at low rates of flow and pressures of oxygen blasting must be suppressed from time to time by interrupting the outflow of oxygen through the annular clearance in casing bore. This, however, invites blocking of said clearance by the material of bath. To prevent the blocking, the annular opening in the casing is fitted with a stopper made of a heatproof material and provided with pores or small holes with a diameter between 0.2 and 5 mm to enable the oxygen to flow. The presence of stopper does not eliminate the possibility of blinding holes by the material of bath and for this reason said stopper must be replaced by a new one from time to time. The stopper is a tight fit into the outlet from tuyere casing and its replacement without breaking or damaging the casing wall is a problem.

SUMMARY OF THE INVENTION

The object of the present invention is to provide a tuyere for introducing reactants into a bath of molten metal which is of a design assurring simplicity of the replacement of the stopper in the event of latter's failure.

Said object is attained by providing a tuyere for introducing reactants into a bath of molten metal comprising an elongated water-cooled tubular casing serving to admit a flow of a gaseous reactant through its bore, fitted with a stopper at the outlet, and a pipe disposed co-axially in said casing for admitting a flow of another reactant said stopper according to the invention, contains nozzles and is secured with its central portion around said pipe, which is installed with provision for axial displacement, while the internal circumferential surface of casing mates the external circumferential surface of the stopper all the way along its circumferential surface so that said stopper can be set into the working position with an interference and withdrawn from the working position with the aid of said movable pipe.

A design like this assures ease of the replacement of the stopper in the event of its failure and a leakproof fitting of the stopper into the working position with an interference.

The internal surface of casing within the limits where the stopper is fitted and the external circumferential surface of the stopper may be given a taper diverging towards the outlet from casing. This will assure a leakproof fitting of the stopper into casing without a clearance.

The stopper, in accordance with the invention, can be made split radially along a plane passing through the generatrix of cone formed by said tapered circumferential surface and may consist of several parts, each provided with means of securing one part to another and fitting the stopper into the working position. A split stopper will assure ease of its removal from a movable pipe in the event of failure.

The internal circumferential surface of the stopper facing the pipe can be provided with an annular recess and the external surface of the pipe, with an annular collar fitting into said recess so that it is assured that the stopper is secured to the pipe and the parts of the stopper tightly fit each other and the casing of the tuyere.

The pipe is installed according to the invention with provision for axial displacement (downwards from the operation position) to a distance of $a$, defined by the relations:

$$a > b \tan \alpha$$

where $b$ is the length of the annular pipe collar; and $\alpha$ is a half angle of the (truncated) cone vertex, which vertex is formed by the conjugated (circumferential) surfaces of the casing and the stopper, providing a clearance therebetween sufficient to assure easy removal of stopper parts and fitting on of new parts.

BRIEF DESCRIPTION OF THE DRAWINGS

The present invention will be best understood from the following detailed description of a preferred embodiment when this description is being read in conjunction with the accompanying drawings in which.

DETAILED DESCRIPTION OF THE PREFERRED EMBODIMENTS

Figure 1:
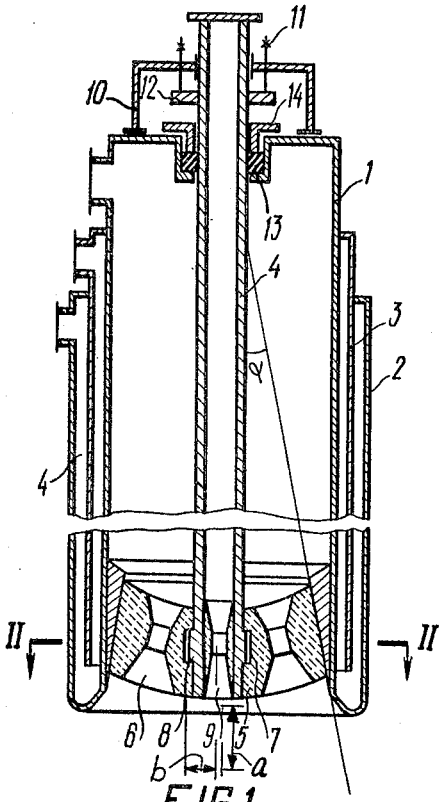
FIG. 1 is a longitudinal section of the tuyere according to the invention.
Figure 2:
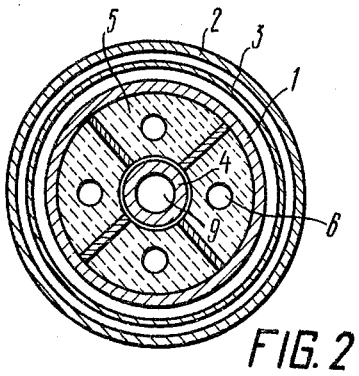
FIG. 2 is a section on line II—II of FIG. 1.

The tuyere consists of an elongated tubular casing 1 serving to introduce a flow of a gaseous reactant, for example oxygen, through its bore. The casing 1 is encircled with two co-axial pipes 2 and 3 which communicate, one with another at a lower end and are used for feeding and discharging the water coolant that cools the casing.

Disposed inside the casing 1 is a co-axial pipe 4 intended to admit a flow of another reactant, a mixture of oxygen with powder materials for example.

Fitted in the casing 1 at its outlet is a stopper 5 made of a heatproof material and pierced by circumferentially-arranged nozzles 6 enabling the oxygen to pass. The number, size and shape of the nozzles 6 may vary depending on the velocity and pressure of the oxygen blasting introduced into the bath of molten metal. The stopper 5 is secured around the pipe 4 by means of an annular recess 7 provided in the internal side surface of the stopper 5 facing the pipe 4 and an annular collar 8 provided at the external surface of the pipe 4, said collar fitting into said recess so as to hold the stopper fast on the pipe 4.

The pipe 4 terminates at its lower end with a nozzle 9 for introducing a flow of oxygen mixed with particulate materials. The pipe 4 can be plugged at its lower end if this is necessary and the tuyere will consequently be used for handling just one flow of a reactant introduced through the bore of the casing 1.

To assure a leakproof fitting of the stopper 5 into the casing 1 without a clearance, the internal circumferential surface of the casing 1, within the limits where the stopper 5 is being installed, and the external circumferential surface of the stopper 5 are given a taper 5*a* diverging toward the outlet from the casing 1.

A leakproof fittingof the stopper 5 and its easy replacement are assured by the fact that the pipe 4 with the stopper 5 accommodated thereon is made movable in the axial direction and is capable of displacing integrally with the stopper 5.

Serving the purpose of axial displacement of the stopper 5, at the top of the pipe 4, there is provided a removable tubular extension piece 10 with threaded pins 11 passing therethrough. The pins 11 are rigidly attached to a flange 12 of the pipe 4 and hold fast the pipe 4 to the extension piece 10.

Placed between the pipe 4 and casing 1 at the place where said pipe enters said casing is a packing 13 held down by a gland 14.

Good accessibility to the stopper 5 for replacing its parts is obtained by displacing the pipe 4 downward from the working position to a distance $a$, defined by $$a > b \tan \alpha$$

where $b$ is the length of the annular collar 8 of the pipe 4 in the radial direction and $\alpha$ is a half-angle of the cone vertex formed by the conjugated (circumferential) surfaces of the casing 1 and the stopper 5. To assure a constant amount of interference irrespective of the relative position of the pipe 4 and casing 1, which may change due to thermal deformation, the pipe 4 may be provided with a tensioning spring (not shown) or any other arrangement serving the same purpose.

When set to its working position, the stopper 5 is a certain distance short of the outlet from the casing 1 of the tuyere and the nozzles 6 are disposed in the stopper 5 at an angle to the axis of the casing 1 so that the jets of reactant issuing from the nozzles keep the material of bath away from the internal surface of the casing 1 and from the stopper 5.

To ease the removal of the stopper 5 from, and fitting on, the pipe 4, said stopper can be made split radially by one or more planes passing through the generatrix of cone. These components of the stopper, when put together, are also provided with the annular recess 7 by means of which said stopper is accomodated on the corresponding annular collar 8 provided on the pipe 4.

The device operates as follows. Prior to the operation the water cooling of the casing 1 of the tuyere put into operation. The tuyere is then set vertically at an optimum height above the surface of a bath of molten metal, which can be a converter. Oxygen is admitted into the bore of the casing 1 and blown through the metal while issuing from the nozzles 6 of the stopper 5. Depending on the process involved, another reactant, for instance, a mixture of oxygen and powder materials can be introduced into the reaction zone through the pipe 4.

A high temperature is developed in the reaction zone during the process of blowing. The tuyere is subjected to the action of vibration and to corrosive gaseous and liquid mediums which results in gradual deterioration of the end of the tuyere and failure of the stopper 5 with the nozzles 6. To replace the damaged stopper 5, with a new one, the tuyere must be removed from a converter and the pipe 4 must be lowered down through a distance which enables free access to the stopper 5. According to the invention, this distance is determined by the relation between the radial size of the movable pipe annular collar and angle of vertex of the cone formed by the conjugated surfaces of the stopper 5 and the casing 1. On spinning off the nuts of the pins 11 passing through the extension piece 10, the pipe is lowered down and the stopper 5 brought out of the casing 1 of the tuyere. Next, the parts of the damaged stopper 5 are removed from the recess 7 in the pipe 4 and replaced by the parts of a new stopper prepared for operation in advance. As soon as the new stopper is back in place, the pipe 4 is lifted upwards until a leakproof interference fit is provided between the stopper 5 and tapered portion of the casing 1 of the tuyere. With the pipe 4 and stopper 5 in said position, the nuts of the pins 11 are turned home so that the lower end faces of nuts are in tight contact with the surface of the extension piece 10, holding fast the pipe 4 in said position. The tuyere is ready for further blowing of the metal.

From the above it is obvious that a damaged stopper 5 with nozzles 6 can be replaced by a new one in a simple way which assures reliable and leakproof fitting of the stopper due to a tight interference fit between the tapered portion of the stopper 5 and the tapered portion of the casing 1 of the tuyere.

We claim:

1. A tuyere for introducing reactants into a bath of molten metal comprising: an elongated water-cooled tubular casing for admitting a flow of a gaseous reactant through its bore; a movable pipe disposed coaxially in said casing with provision for axial displacement and serving to admit a flow of another reactant through its bore; means for making possible the axial displacement of said pipe; a stopper disposed at the outlet of said casing and fixed to said movable pipe so that the external circumferential surface of said stopper mates with the internal circumferential surface of said casing at the area where said stopper is fitted assuring the setting of said stopper into its working position with an interference fit, the withdrawal of said stopper from its working position for occasional replacement being accomplished by moving said movable pipe along its axial direction; and nozzles being provided in said stopper for admitting the flows of reactants.

2. The tuyere as claimed in claim 1, wherein the internal circumferential surface of said casing at the area where said stopper is fitted and the external circumferential surface of the stopper are given a taper diverging towards the casing outlet.

3. The tuyere as claimed in claim 2, wherein said stopper is split radially along the planes passing through the generatrices of the cone and comprises several parts, each of said parts provided with means for its being secured into the working position on said movable pipe.

4. The tuyere as claimed in claim 3, wherein the internal circumferential surface of said stopper facing said movable pipe is provided with an annular recess, and the external surface of said movable pipe is provided with an annular collar fitting into said recess thereby assuring that the stopper is secured on said pipe.

* * * * *